United States Patent [19]

Faltin

[11] Patent Number: 4,506,873

[45] Date of Patent: Mar. 26, 1985

[54] BRAKING MEANS FOR MOVING PAPER PRODUCTS ENTERING FOLDERS

[76] Inventor: Hans G. Faltin, 4135 Wilshire Dr., York, Pa. 17402

[21] Appl. No.: 585,181

[22] Filed: Mar. 1, 1984

[51] Int. Cl.[3] ..... B42C 1/00

[52] U.S. Cl. ..... 270/46; 271/270; 493/416; 270/59

[58] Field of Search ..... 270/41, 45–50, 270/59; 393/405, 416, 417, 437; 198/644; 192/138–140, 125 F, 126; 271/270

[56] References Cited

U.S. PATENT DOCUMENTS

| | | | |
|---|---|---|---|
| 2,821,386 | 1/1958 | Petre | 270/32 X |
| 3,995,850 | 12/1976 | Hertrich et al. | 74/25 |
| 4,093,203 | 6/1978 | Fischer et al. | 270/50 |
| 4,279,410 | 7/1981 | Bolza-Schunemann | 270/6 |

FOREIGN PATENT DOCUMENTS

| | | | |
|---|---|---|---|
| 994316 | 6/1965 | United Kingdom | 493/416 |

*Primary Examiner*—E. H. Eickholt

*Attorney, Agent, or Firm*—Laurence R. Brown

[57] ABSTRACT

A higher speed paper sheet product cross or quarter folding system is afforded for use with high speed paper product transport conveyors such as used with web printing presses, and the like producing signatures. The higher speed is obtained by novel braking means for gradually slowing down the paper product, non-linearly, as it enters the folding station, thereby preventing damage to the product or erratic folding caused by high speed impact with the fixed stop in the folder that has previously prevented the system from running at the higher speeds that can now be obtained by this improved system. Moving slow down stops are carried by a cyclically moving timing belt to intercept a paper product moved thereinto at higher speed by a conveyor. This moving stop is synchronously timed to intercept the paper product moving at a highest transit speed and is non-linearly moved to slow the paper product down to a lowest speed before it engages the fixed stop for folding. Typically a set of elliptical gears provides the non-linear timing belt slow down stop speed speed ratio of four to one and the system reduces the signature impact speed at the fixed stop by at least 60% from the conveyor speed of entry into the folding station.

6 Claims, 8 Drawing Figures

BRAKING MEANS FOR MOVING PAPER PRODUCTS ENTERING FOLDERS

TECHNICAL FIELD

This invention relates to cross folding or quarter folding systems used with high speed web presses, wherein paper product conveyers carry rapidly moving products or signatures to a folding station, and more particularly it relates to product braking means for gradually slowing and stopping a rapidly moving paper product or signature at a quater folding station.

BACKGROUND ART

Folding means for paper sheet products, known as signatures, that are moved thereinto on a conveyance belt to be cross folded or quarter folded are known in the art as quarter folders. Typical of this art is the system disclosed in U.S. Pat. No. 3,995,850, Dec. 7, 1976 to K. Hertrich et al. wherein paper products are conveyed by a conveyer belt into a folding station. However, when such folders are required for high speed processing equipment such as high speed web printing presses and the like, there has been a problem because of the need to stop the paper product at the folding station prior to the actual folding operation to guarantee an accurate and consistent fold. If a paper product is moved into a stop at the folding station at high speed the inertia and momentum will cause the product to bounce or collapse spasmodically, resulting in irregular folds. Thus, the quarter folder has been a speed bottleneck limiting rotary press speeds to 25,000 to 30,000 per hour when an accurate quarter folded product is required. Some typical solutions in the prior art are represented by U.S. Pat. Nos. 4,279,410 issued July 21, 1981 to H. B. Bolza-Schunemann for putting a plurality of the folders in parallel to respectively receive the paper products diverted off the conveyance line, and 2,821,386 issued Jan. 28, 1958 to J. R. Petre for non-linearly moving a folder blade into the product in order to overcome impact problems of the folder in an effort to improve the throughput speed.

Nevertheless, in all the known prior art, there has not been any suitable means to speed up significantly the rate of quarter folding products delivered on a high speed conveyance belt more than a few thousand products per hour attained when the products delivered on a high speed conveyance belt are slowed down a small percentage (approximately 8%) of the delivery rate before the impact of the product upon the fixed stop at the folding station.

DISCLOSURE OF THE INVENTION

High speed web printing presses equipped with the standard "chop type" quarter folder permitting the "half fold" signature coming from the press folder between conveying belts to be cross or quarter folded are limited to a speed of 25,000 to 30,000 folded signatures per hour due to the fact that the signatures must come to a complete stop before the "chop knife" cross folds the product. Above this speed the signatures bounce and become unstable resulting in inaccurate folds, wrinkles and damaged products.

This problem is resolved by providing gradual slow down and braking means in the form of cyclically driven timing belts or chains equipped with movable stops and a non-linear drive mechanism permitting the paper product or signature to be gradually slowed to only one-fourth of its linear speed, thus permitting much higher press speeds when quarter folding.

Other objects, features and advantages of the invention will be found throughout the following description, drawing and claims.

THE PREFERRED EMBODIMENT

Figure 1:
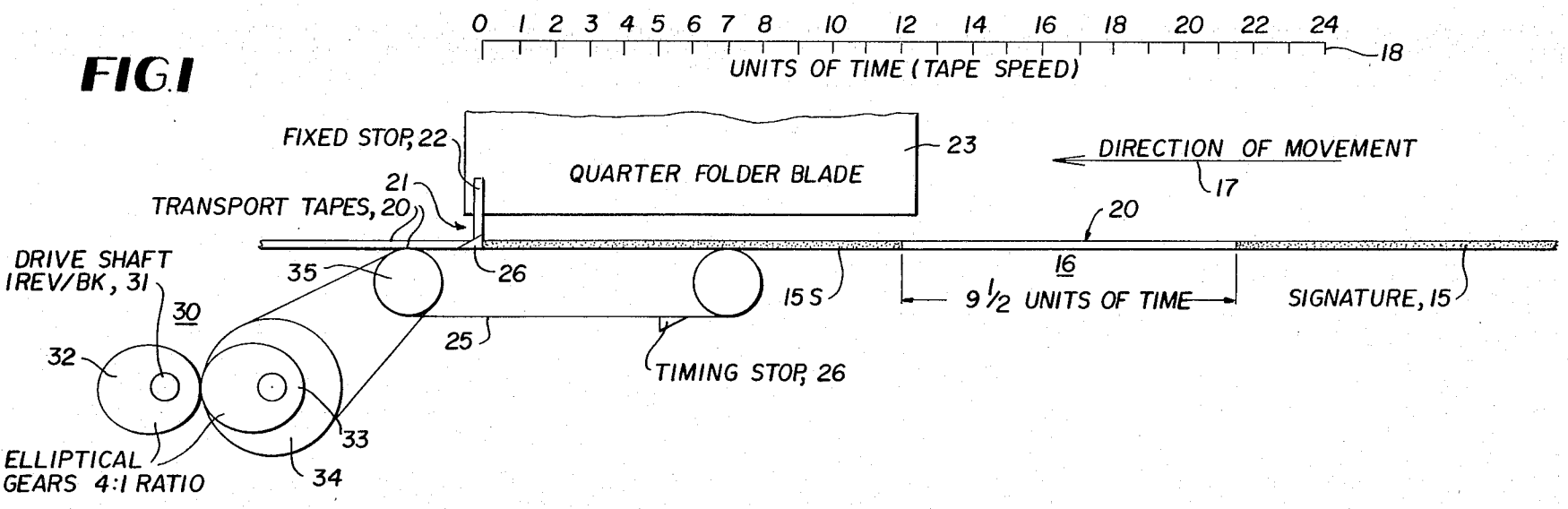
FIG. 1 is a diagrammatic sketch of a paper product or signature conveyance, braking and folding system embodying the invention.

As may be seen from FIG. 1, paper sheet products, which may be termed in the trade as signatures 15, are separated by a fixed spacing 16. This spacing is set forth in units of time, based upon the transit speed of the signatures before the timing stop 26 is impacted, as established by the constant speed conveyor belts between which the products are carried in the direction of arrow 17. The belts comprising separated longitudinally travelling tapes or bands, may run at different speeds. The total length of the signature may vary from press to press. The shown nine and one-half units of time by which the signatures are spaced relate to the synchronous operation of the various interacting units, namely the conveyance means, the braking means and the folding means. In this respect the timing chart 18 relates to the travel time from the front of one signature 15S to the front of the following signature 15 between the conveyor belts 20 as they approach and enter the folding station 21 when travelling linearly along the conveyor belt transit path.

When the signature 15S is stopped by fixed folder stop 22 at the folding station for folding by the quarter folder blade 23, as shown, the blade moves downwardly between the transport tapes in a conventional manner to fold and remove signature 15S and return to its raised position to await the next signature in line between the conveyor belts. Because the signatures 15 need be stopped at fixed stop 21 to assure consistent and accurate folding, the speed of the folding system is limited to that at which the impact of the product at the stop will not cause the product to be damaged or to bounce causing an erratic fold. Since this embodiment permits the signature 15 to strike the fixed stop at one-quarter of the conveyance speed, it follows that the folder could run up to four times faster than the same folder without the improvement provided by this invention.

Thus, in accordance with this invention, the timing belts, or chains 25 are provided with movable stops 26 that are introduced between the belt tapes 20 at a time synchronized with the spacing 16 between signatures 15S and 15, thereby to intercept the moving signatures 15 and slow them down gradually before they impact the fixed stop 22. The increase in belt speed is limited to about 8%, before the next signature would run into the quarter folder blade because of the units of time involved. Thus the driving means 30 for the timing belts are provided to non-linearly drive the timing belts 25 to present the braking stops 26 into the gap 16 between the signatures 15S and 15 so that the folder can operatae at a higher speed than formerly limited by the transport speed of the conveyor belt tapes 20. Thus the signatures 15 are quickly but gradually slowed down to one-quarter of their original speed on the belts 20 as they approach the fixed stop 22 when entering tahe folding station 21. It is thereby seen that the transport speed along the conveyor belt means 20 can be significantly increased to permit folding of a greater number of paper products per hour by the folding system afforded by this invention.

The non-linear timing belt drive means 30 operates synchronously with the paper product transport portion of the system by means of the drive shaft 31 that makes one revolution per signature (24 units of time). Thus elliptical gears 32 and 33, by means of belt drive wheels 34 and 35, serve to time the two timing stops 26 on the timing belt 25 to synchronously engage the successive signatures 15 presented to the folding station 21. Preferably the timing belt is cogged or a chain drive is employed to prevent slipping out of synchronism.

Figure 2:
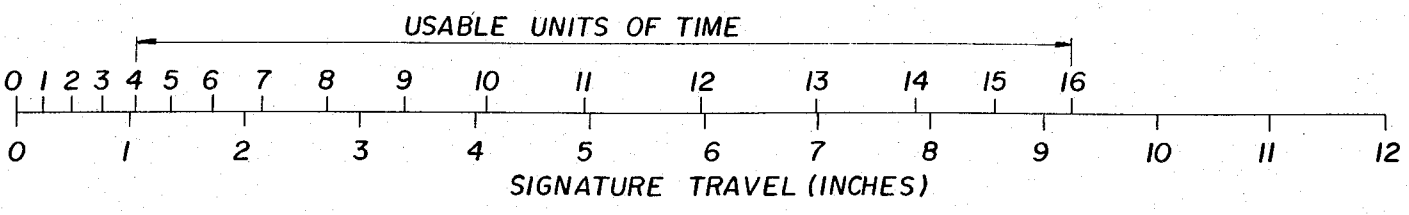
FIG. 2 is a timing chart illustrating the non-linear drive characteristics of the braking system afforded by this invention.

By use of the four to one gear ratio, achieved by the shown gear dimensions, the impact against the fixed stop 22 may be decreased as much as three-fourths. The resulting slow down of the product 15 between the engagement with moving stop 26 and the fixed stop 22 is four to one as shown by the timing chart of FIG. 2. Thus, the minimum movement per unit of time occuring at the time of impact at the fixed stop 22 is ¼ inch (0.6 cm) if the maximum movement per unit time, at the time of impact of the product 15 with the moving stop 26, is one inch (2.5 cm). That means that the conveyance speed of the products 15 along the conveyor belt 20 may be increased four to one over that at which could occur if the timing belt 25 were travelling at a constant linear speed, and thus the folding system afforded by this invention unexpectedly results in a significant increase in the speed at which the paper products 15 can be folded.

Figure 3:
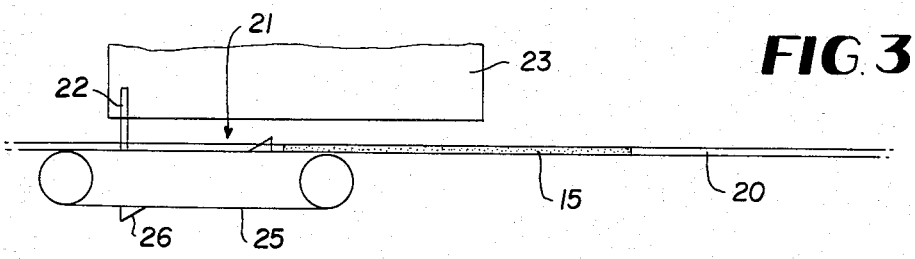
FIGS. 3 to 8 are time sequential diagrammatic views showing the interaction between the paper product or signature transport means, braking means and folding means as the product or signature enters and leaves the folding station.
Figure 4:
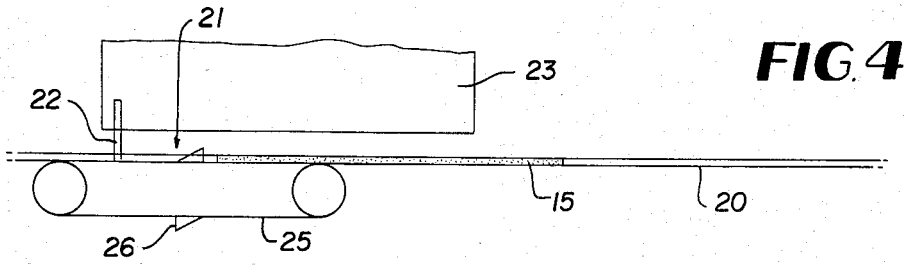
Figure 5:
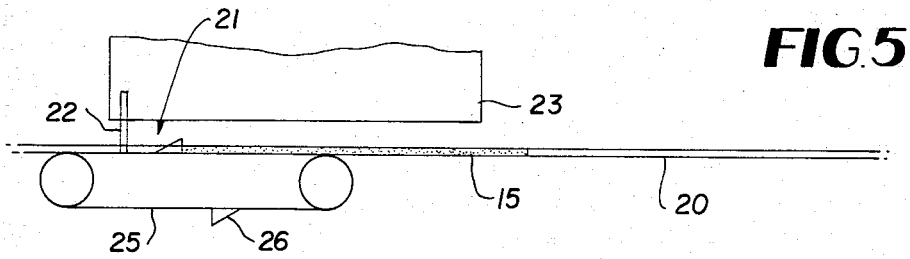

The movement of the paper product 15 along conveyor means 20 as it enters the folding station 21 at several representative times within the timing belt cycle is represented by FIGS. 3 to 8. Thus, as seen in FIG. 3, the signature 15 as it is entering the folding station 21, is travelling at a higher speed than the moving stop 26, and over a period of four or five units of time as represented in FIGS. 4 and 5 catches up and impacts the moving stop to align and slow down the signature 15.

Figure 6:
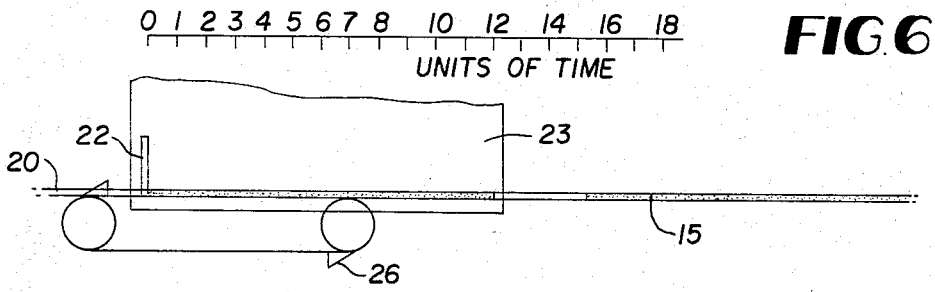

Then as illustrated in FIG. 6 when signature 15 hits fixed stop 22 at its minimum speed of about 25% of the transport belt 20 speed, the folding cycle begins with blade 23 moving downwardly. The signatures typically strike the fixed stop at a speed of about ⅜ unit of time or approximately 62% slower, without decreasing the travel approach time of about one unit of time on the conveyor belts 20. In other words the conveyor belt and folder may be run at a correspondingly higher speed without damage to the signatures caused by the impact with fixed stop 22. In this given example, the timing belt is 24 inches (61 cm) long with two moving stops 26 spaced by 12 inches (30 cm), where each 12 inches is divided into 24 units of time in which the entry unit of time conveys the signatures 15 at one inch (2.54 cm) per unit time and the smallest unit of time conveys the signatures at ¼ inch (0.6 cm) per unit time.

Figure 7:
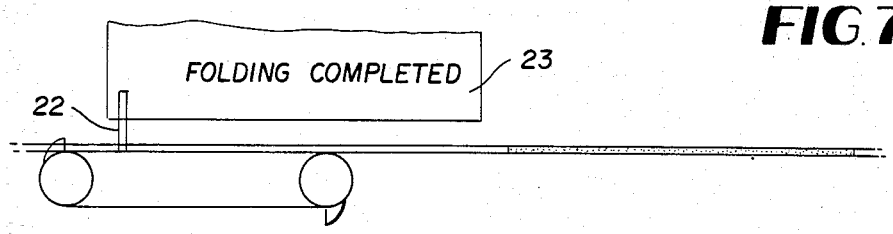
Figure 8:
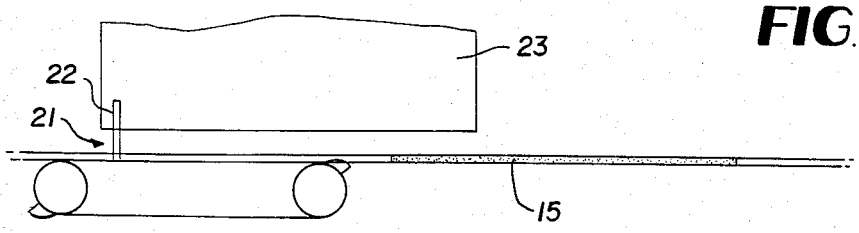

As seen from FIGS. 7 and 8, the folding blade 23 is returned upwardly and the folded signature is removed from the conveyor belt during the gap between the signatures 15 (9½ units of time) to permit entry of the next successive signature during the next timing belt half cycle. The folding is completed in eight units of time and the next signature 15 enters the vicinity of folding station 21 for the following folding cycle as shown by FIG. 8.

It is therefore evident that this invention has improved paper product cross or quarter folding systems such as used in high speed web printing presses to permit higher speed operation in a manner unexpected and not available in the prior art and thus those features of novelty believed descriptive of the spirit and nature of the invention are defined with particularity in the following claims.

I claim:

1. The improved method of increasing the quarter folding speed of a sequence of signatures coming from high speed web pess folders, comprising the steps of, conveying the signatures along a transit path in synchronous timing with gaps between successive signatures, synchronously engaging the individual signatures by inserting a slow down stop moving at near the transit speed of the signatures along the transit path in said gaps between the signatures, significantly reducing the speed of the moving signature by controlling the speed of the moving stop nonlinearly, and stopping the signatures by striking a fixed stop at a quarter folding station when the signatures are travelling at a significantly reduced speed.

2. A high speed paper product cross folding system comprising in combination, conveyance means for conveying a succession of sheet products along a transit path, folding means with a stop disposed at a folding station for impacting the sheet products conveyed thereto along the transit path thereby to stop and fold the sheet products, braking means operable on paper products conveyed by said conveyance means for decreasing the conveyance speed of the sheet products into the folding station characterized by a cyclically driven timing belt array for intercepting the paper products passed along the transit path by the conveyance means adapted for transporting sheet products into the folding station at a lower transit speed than that of the sheet products carried along the transit path by the conveyance means before interception of the timing belt, said timing belt being provided with cyclically movable sheet product intercepting means for intercepting and slowing down the speed of the sheet products in the transit path, and drive means for the timing belt and its intercepting means providing a non-linear transit speed of the paper products intercepted thereby adapted to slow down gradually the paper products intercepted by the intercepting means when approaching said folding station while maintaining a substantially higher average speed of the paper product in said transit path afforded by the conveyance means thereby to engage the paper products by the belt intercepting means and thereafter slowing down the transit speed of the paper products to strike the fixed folder stop at a greatly reduced speed so that the paper products are not folded erratically and furthermore permitting the folder to process a greater number of the paper products per hour than possible with linear drive means because of gradually reduced speed of the paper products afforded by the intercepting means.

3. A system as defined in claim 2, wherein the belt drive means comprises a rotary drive mechanism for cyclically driving the belt and a mechanism coupled therewith from a drive shaft to produce said non-linear transit speed slowing down the paper products.

4. A system as defined in claim 3 wherein the belt intercept means comprises at least two timing stops moving at a predetermined speed at the cyclic position at which the paper products engage the intercept means causing the stops to intercept the paper products thereby to align the paper products and provide a slow down stop against which the paper products abut, and whereby the products are then further slowed down by said non-linear speed to appear at the folding station stop at substantially the lowest transit speed along said transit path.

5. A system as defined in claim 4 wherein the belt drive means has a drive ratio of four to one between the speed at which the paper product is intercepted and the speed at which the paper product is presented to the folding station stop.

6. A system as defined in claim 3 wherein said mechanism comprises a set of elliptical gears.

* * * * *